US008186327B2

(12) United States Patent
Ni

(10) Patent No.: US 8,186,327 B2
(45) Date of Patent: May 29, 2012

(54) OIL SUPPLY SYSTEM FOR INTERNAL COMBUSTION ENGINE WITH DUAL MODE PRESSURE LIMITING VALVE

(75) Inventor: Ben Xuehai Ni, Canton, MI (US)

(73) Assignee: Ford Global Technologies, Dearborn, MI (US)

( * ) Notice: Subject to any disclaimer, the term of this patent is extended or adjusted under 35 U.S.C. 154(b) by 398 days.

(21) Appl. No.: 12/364,007

(22) Filed: Feb. 2, 2009

(65) Prior Publication Data

US 2010/0192898 A1 Aug. 5, 2010

(51) Int. Cl.
*F01M 1/04* (2006.01)
*F01M 1/00* (2006.01)

(52) U.S. Cl. ..... 123/196 CP; 123/196 S

(58) Field of Classification Search ..... 123/196 S, 123/196 CP
See application file for complete search history.

(56) References Cited

U.S. PATENT DOCUMENTS 3,485,324 A * 12/1969 Novak ..... 184/6
4,535,805 A * 8/1985 Mertz ..... 137/489
4,644,748 A * 2/1987 Goss et al. ..... 60/395
5,085,181 A 2/1992 Feuling
5,249,556 A 10/1993 Emmitt
5,339,776 A * 8/1994 Regueiro ..... 123/196 CP
5,509,381 A 4/1996 Fisher
6,244,385 B1 * 6/2001 Tsubata et al. ..... 184/6.4
6,374,603 B1 * 4/2002 Morita et al. ..... 60/421
6,457,696 B1 * 10/2002 Hirota ..... 251/30.02
6,669,453 B1 * 12/2003 Breeden et al. ..... 417/364
7,331,323 B2 * 2/2008 Hara ..... 123/196 A
7,578,761 B2 * 8/2009 Nishikawa et al. ..... 475/127
7,819,093 B2 * 10/2010 Yamashita et al. ..... 123/41.35
2002/0083915 A1 7/2002 Choi
2005/0045142 A1 3/2005 Rozario et al.
2006/0070600 A1 4/2006 Hara

* cited by examiner

*Primary Examiner* — Noah Kamem
*Assistant Examiner* — Grant Moubry
(74) *Attorney, Agent, or Firm* — Jerome R. Drouillard; Julia Voutyras

(57) ABSTRACT

A lubricating oil supply system for internal combustion engine includes an oil reservoir and oil pump connected with a lubrication distribution network including a piloted pressure relief valve which selectively controls the pressure within the distribution network to at least one pressure value that is less than the maximum pressure produced by a primary pressure relief valve associated with the oil pump, while also protecting the lubrication distribution network from an unwanted overpressure condition.

10 Claims, 3 Drawing Sheets

OIL SUPPLY SYSTEM FOR INTERNAL COMBUSTION ENGINE WITH DUAL MODE PRESSURE LIMITING VALVE

CROSS REFERENCE TO RELATED APPLICATIONS

None.

BACKGROUND OF THE INVENTION

1. Field of the Invention

The present invention relates to an internal combustion engine lubrication system in which maximum pressure within the lubrication system is controlled by a dual mode pressure limiting valve.

2. Related Art

Pressure-lubrication has been used with automotive internal combustion engines for many years. Typically, a single pressure relief valve is used to limit the maximum pressure developed by an oil pump. The relief pressure is usually set at a fairly high value, in order to assure that the engine receives adequate lubrication in all operating regimes from idle to maximum speed-load operation. Unfortunately, this causes the lubrication pump's energy consumption to be higher than would otherwise be ideal, because in many operating regimes, only a reduced volume and pressure of oil is required by the engine.

US Patent Publication 2002/0083915 discloses a system in which a minimum oil pressure is established by a mechanically operated valve, with an electrically operated valve positioned in the mechanical valve's relief port such that the system pressure may be increased through closure of the electronically operated valve. This system suffers from the drawback that the electrically operated valve does not have a fail-safe position. In the event that the electrically operated valve fails in an open position, only minimal oil pressure would be available to sustain the engine, and such minimal oil pressure would undoubtedly be inadequate to support the engine during high speed and load operation. On the other hand, if the electrically operated valve fails in a closed position, the resulting excessive oil pressure may damage or destroy the engine by causing the oil filter to rupture, with a consequent loss of all oil overboard. In other words, any failure of the electronic valve could lead to engine failure. In another vein, the reliability of the electrically operated valve is compromised because only unfiltered oil flowing from the oil pump passes through the valve, and foreign matter carried by the unfiltered oil may cause the valve to stick or wear excessively.

It would be desirable to provide an internal combustion engine lubrication system in which an engine is reliably protected with a redundant high pressure mechanical relief valve, combined with the capability of reducing the oil pressure so as to promote fuel economy improvement during operating regimes in which maximum oil pressure and flow are unneeded.

SUMMARY OF THE INVENTION

According to an aspect of the present invention, a lubricating oil supply system for an internal combustion engine includes an oil reservoir and an oil pump for pressurizing oil from the reservoir. A lubrication distribution network is connected with the oil pump. A primary pressure relief valve is connected to the distribution network downstream from the oil pump. The primary pressure relief valve limits oil pressure within the distribution system to a maximum permissible value. A pilot-controlled, dual mode pressure relief valve, operatively connected with said distribution network downstream from said primary pressure relief valve, selectively controls the pressure within said distribution network to a minimum pressure which is less than the highest pressure produced by the primary pressure relief valve.

According to another aspect of the present invention, a dual-mode, piloted pressure relief valve, operatively connected with an oil distribution network downstream from a primary pressure relief valve, controls the pressure within the distribution network by returning oil from the distribution network to the oil reservoir, with the piloted pressure relief valve having a first operating mode, in which a pilot valve is energized, wherein the piloted pressure relief valve limits the pressure within the distribution network to a first pressure which is less than the highest pressure produced by a primary pressure relief valve, and a second operating mode, in which the pilot valve is not energized, wherein the piloted pressure relief valve limits the pressure within the distribution network to a second pressure value which is greater than the first relief pressure.

It is an advantage of a lubricating oil supply system according to the present invention that engine fuel consumption may be reduced by minimizing parasitic losses associated with an engine driven lubricating oil pump, while at the same time safeguarding the engine's integrity, by using a piloted pressure relief valve having a normally closed pilot valve, such that if the pilot valve operating system fails, the engine oil pressure will be maintained at a safe level for all engine operating modes and regimes.

It is another advantage of a system according to the present invention that the piloted pressure relief valve of the present invention may be mounted externally upon the engine, as opposed to the known conventional practice of mounting of relief valves deep inside an engine, such as in an engine oil pump, rendering such valves relatively inaccessible for service purposes.

It is yet another advantage of a system according to the present invention that the piloted pressure relief valve of the present invention may be located downstream from an oil filter, thereby protecting the pressure controller from oil-borne contamination.

It is yet another an advantage of a system according to the present invention that the inventive piloted pressure relief valve has a dual mode feature, whereby the piloted valve may be used to limit maximum lubrication system pressure in the event that a primary relief valve fails in a closed position.

It is yet another an advantage of a system according to the present invention that flow of lubricating oil through an engine will not be diminished when the present dual mode valve is not operating in a pressure limiting mode.

Other advantages, as well as features of the present invention, will become apparent to the reader of this specification.

DETAILED DESCRIPTION OF THE PREFERRED EMBODIMENTS

Figure 1:
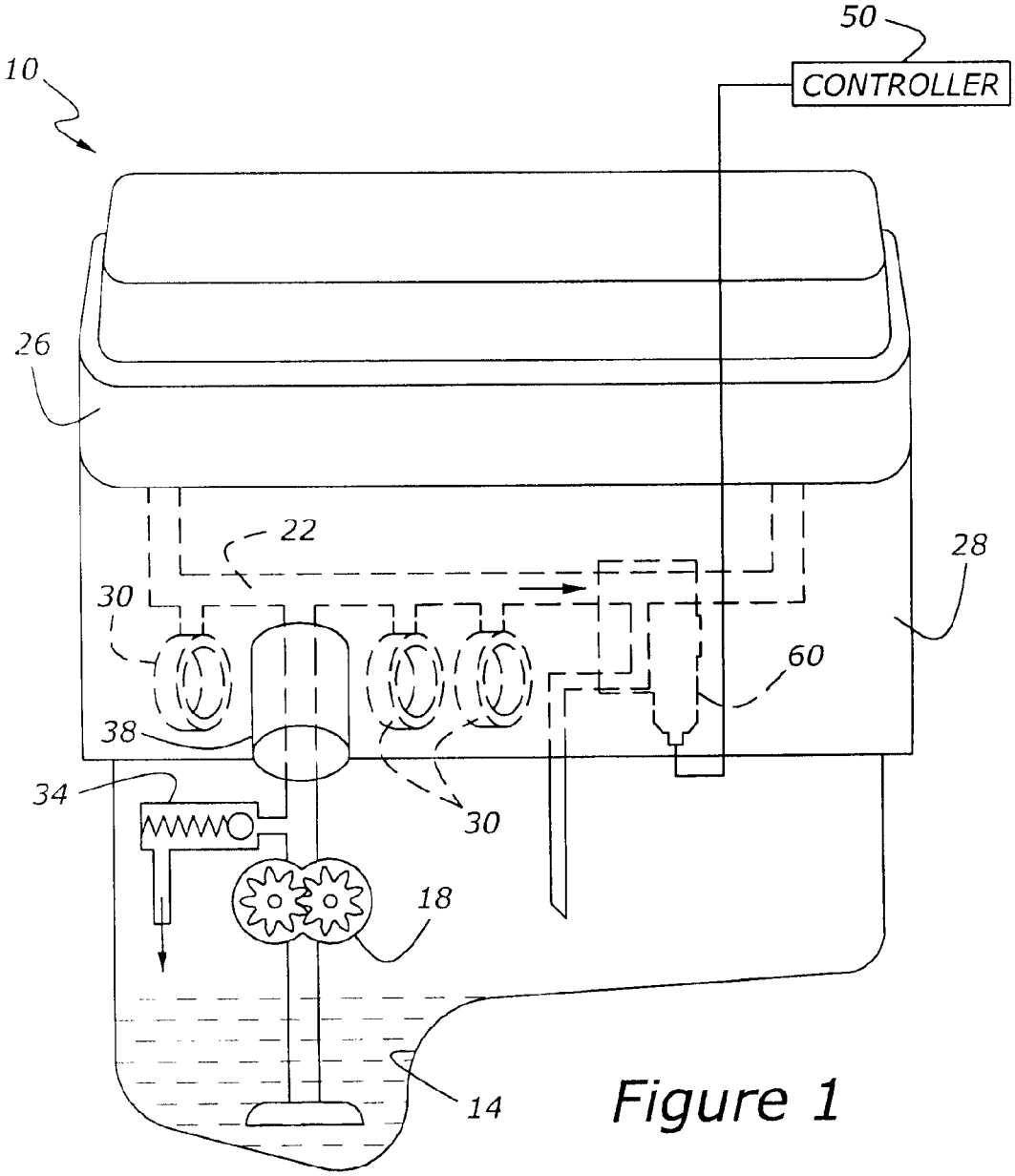
FIG. 1 is a schematic representation of an internal combustion engine having a lubricating oil supply system according to the present invention, in a normal operating condition.

As shown in FIG. 1, an engine, 10, has an oil reservoir, 14, extending below a cylinder block, 28, and a cylinder head, 26. A lubrication distribution network, 22, is connected with an oil pump, 18. Those skilled in the art will appreciate in view of this disclosure that oil pump 18 could comprise either a gerotor type pump either driven concentrically by an engine crankshaft, or a gear pump or gerotor pump, typically mounted to the engine's cylinder block and driven by either a camshaft or another rotating component of the engine, or yet other types of pump arrangements. Such detail is committed to those wishing to employ the inventive oil supply system described and claimed herein.

The present lubricating oil supply system includes not only oil reservoir 14, oil pump 18, and lubrication distribution network 22, but also a primary pressure relief valve, 34, employed to limit the oil pressure within distribution network 22 to a maximum permissible value. In other words, pressure relief valve 34 clips the oil pressure to a predetermined maximum value. This protects, for example, oil filter 38 from destruction were the oil pressure to be too high during cold operation at higher engine speeds.

The present system also includes a pilot-controlled, dual mode pressure relief valve, 60. Valve 60 is operatively connected with distribution network 22 downstream from primary relief valve 34 and preferably downstream from oil filter 38.

Figure 2:
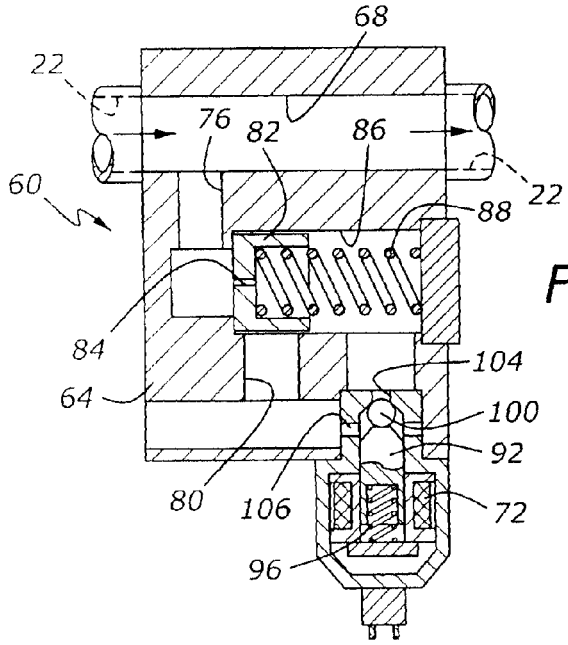
FIG. 2 is a partially schematic representation of a piloted pressure relief valve used in an engine lubrication supply system according to an aspect of the present invention, operating in a high pressure, redundant relief condition.

In the absence of any signal from controller 50, valve 60 functions as a normally closed pressure relief valve having a pressure setting which approximates the setting of primary relief valve 34. Thus, the lubrication system will function as shown in FIG. 1, with the normal pressure relief function being handled by primary relief valve 34. Valve 60, however functions as a backup maximum pressure valve as follows. Turning to FIG. 2, valve 60 is shown as having a body, 64, with a normal, full-flow passage, 68. When valve 60 is not energized, oil will continue to flow through valve 60 without any diminution because full-flow passage 68 offers no significant restriction to flow.

FIG. 2 illustrates a condition in which controller 50 is not providing a signal voltage to opening coil 72 of valve 60. Operating plunger 82 is urged in the direction of closing by the force of a resilient element, illustrated as spring 88. Spring 88 is selected so that operating plunger 82 remains in its closed position unless the pressure differential acting upon plunger 82 exceeds a predetermined first pressure which is less than the pressure setting of primary relief valve 34. When there is no opening force from opening coil 72, control ball 100 is pushed to its closed position by the force of spring 96 acting through armature 92. Spring 96 is selected to maintain ball 100 in its closed position unless the pressure acting upon ball 100 exceeds a predetermined second pressure which is preferably slightly above the relief pressure of primary relief valve 34. Accordingly, valve 60 acts as a backup pressure relief valve to keep system pressure from increasing to an unwanted level. In a preferred embodiment, valve 60 will be set to relieve at a pressure slightly above the relief pressure of primary relief valve 34.

In the condition illustrated in FIG. 2, spring 88 is able to maintain operating plunger 82 in its closed position during normal lubrication system operating pressures because bleed orifice 84 causes the pressure of oil acting within distribution network 22 act equally on both the active side of plunger 82, which is exposed to the pressure within passage 68, and the control side, which is exposed to hydraulic control pressure and the pressure of spring 88. If, however, the pressure within lubrication network 22 increases above the second pressure setting, control ball 100 will be forced off its seat against the force of spring 96, which acts upon control armature 92. In essence, control ball 100 and spring 96 function as a secondary maximum pressure relief valve, providing redundant protection against system overpressure.

Figure 3:
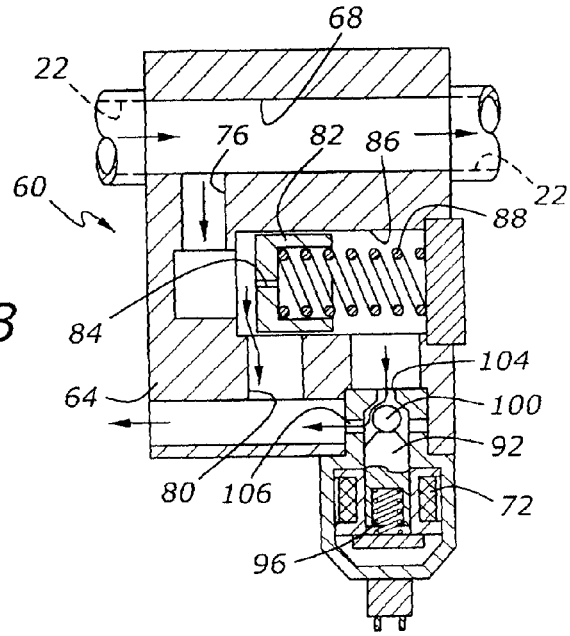
FIG. 3 shows the valve of FIG. 2 operating in a fail-safe pressure relief mode.

Once control ball 100 has been displaced from its seat due to an overpressure episode, the pressure at the control side of operating plunger 82 decreases and operating plunger 82 opens to allow oil to flow into outlet passage 80. This condition is shown in FIG. 3. When valve 60 is operating in this mode, the pressure within lubrication distribution network 22 is determined by the sizing of spring 88 and outlet passage 80, as well as by the sizing of control orifice 104 and spring 96. While operating in the emergency pressure limiting mode, ball 100 will be unseated from orifice 104 by only a small amount, as shown in FIG. 3.

Figure 4:
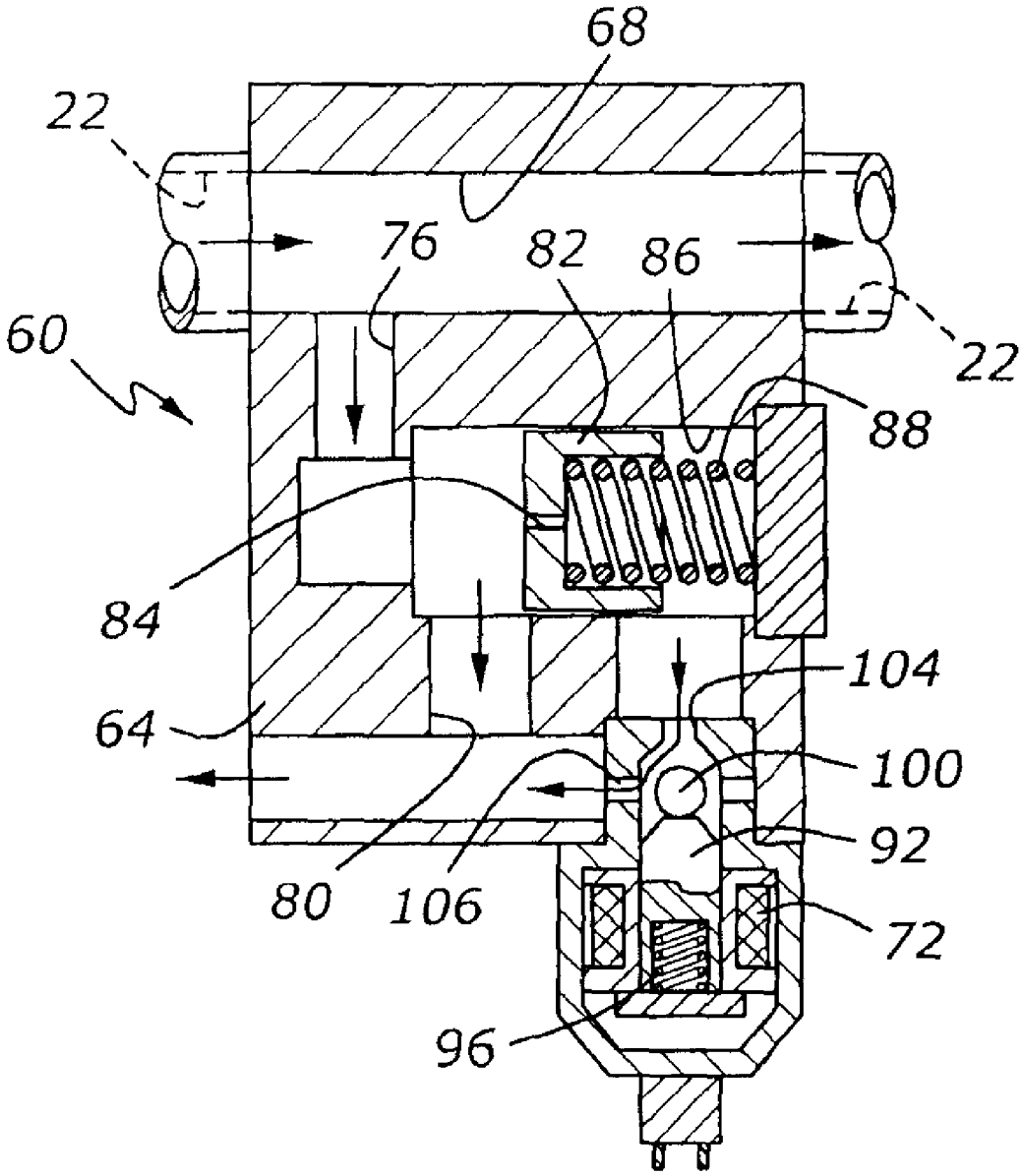
FIG. 4 is similar to FIG. 3 but shows the valve of FIG. 3 operating in a low pressure, fuel saving condition, as opposed to the higher pressure operation shown in FIG. 3.

The operating mode depicted in FIG. 4 is achievable through electronic control of opening coil 72, which is connected with controller 50. Energization of coil 72 displaces armature 92 in a direction away from control orifice 104, allowing control ball 100 to permit flow through passage 106 and into reservoir 14. Because orifice 104 and passage 106 are much larger than bleed orifice 84, the control pressure within bore 86 will be much less than the pressure within passage 76, thereby allowing operating plunger 84 to be pushed open against the force of spring 88, bypassing oil and reducing the oil pressure to the first pressure setting. Those skilled in the art will appreciate in view of this disclosure that the pilot function of the present device is implementable not only with the illustrated spring-loaded ball and plunger, but alternatively by a fluidically or electronically controlled spool valve.

As shown in FIG. 1, valve 60 is placed downstream from primary relief valve 34. When valve 60 is operating in the condition of FIG. 4, oil pump 18 is required to do less work because oil is pumped against a lower head. Because valve 60 is normally closed, a loss of signal from controller 50 will merely cause the lubrication system to revert to a maximum pressure system controlled by not only by primary pressure relief valve 34, but also by the previously described pressure relief function of valve 60. This protects the integrity of engine 10.

Although oil is bypassed at a lower pressure by valve 60, adequate oil pressure is provided to cylinder head 26 and to crankshaft bearings 30 because valve 60 is opened by controller 50 only during the several operating regimes in which it is not necessary to provide maximum oil pressure to sustain appropriate engine life. In fact, in many operating regimes such as those characterized, for example, by operation at less than half of the engine's maximum load, oil pressure may be significantly reduced while still providing adequate lubrication to the engine.

Valve 60 is preferably mounted to an external surface of engine 10, such as an outer surface of cylinder block 28. Such external mounting is shown in FIG. 1. This will permit relatively easy access to valve 60 for the purposes of repair or adjustment, without the necessity of removing engine hardware such as the oil pan or front cover. In a preferred embodiment, valve 60 is mounted upstream of any of crankshaft bearings 30.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A lubricating oil supply system for an internal combustion engine, comprising:

an oil reservoir;

an oil pump for pressurizing oil from said reservoir;

a lubrication distribution network connected with said pump;

a primary pressure relief valve, connected downstream from said oil pump, for limiting the oil pressure within said distribution network to a maximum value; and a pilot-controlled, pressure relief valve, operatively connected with said distribution network downstream from said primary pressure relief valve, for selectively controlling the pressure within said distribution network to a minimum pressure which is less than the highest pressure regulated by the primary pressure relief valve, wherein said pilot controlled valve is operated by an engine controller configured to control engine oil pressure according to at least the operating speed of the engine.

2. A lubricating oil supply system according to claim 1, wherein said lubrication distribution network comprises a plurality of passages extending through an engine.

3. A lubricating oil supply system according to Claim 1, wherein said lubrication distribution network comprises a plurality of passages extending through an engine to crankshaft bearings and at least one cylinder head.

4. A lubricating oil supply system according to claim 1, wherein said pilot controlled relief valve comprises:

a housing;

a minimum pressure relief valve, contained within said housing, for controlling oil pressure within the distribution network to a predetermined value which is less than the highest pressure regulated by the primary pressure relief valve; and a pilot valve for controlling the operation of said minimum pressure relief valve, with said pilot controlled valve being operated by said engine controller.

5. A lubricating oil supply system according to claim 1, further comprising an oil filter connected with said distribution network between said primary pressure relief valve and said pilot controlled valve.

6. An internal combustion engine with a lubricating oil supply system, comprising:

an oil reservoir;

an oil pump mounted to said engine, with said oil pump having an inlet and an outlet, with the oil pump picking up oil from said reservoir and pressurizing said oil;

a lubrication distribution network connected with said pump;

a primary pressure relief valve, connected in said distribution network downstream from said oil pump, for limiting the oil pressure within said distribution network to a maximum permissible value; and a dual-mode, piloted pressure relief valve, operatively connected with said distribution network downstream from said primary pressure relief valve, for controlling the pressure within said distribution network by returning oil from the distribution network to the oil reservoir, with said piloted pressure relief valve having a first operating mode, in which a pilot valve is energized, wherein the piloted pressure relief valve limits the pressure within the distribution network to a first pressure which is less than the highest pressure regulated by the primary pressure relief valve, and a second operating mode, in which the pilot valve is not energized, wherein the piloted pressure relief valve limits the pressure within the distribution network to a second pressure value which is greater than said first pressure, wherein said piloted pressure relief valve is operated by an engine controller according to at least the operating speed of the engine.

7. An engine according to claim 6, wherein said lubrication distribution network comprises a plurality of passages extending through the cylinder block to crankshaft bearings, an oil filter, and a cylinder head.

8. An engine according to claim 6, wherein said piloted pressure relief valve is located externally of said cylinder block.

9. An internal combustion engine with a lubricating oil supply system, comprising:

an oil reservoir;

an oil pump mounted to said engine, with said oil pump having an inlet and an outlet, with the oil pump picking up oil from said reservoir and pressurizing said oil;

a lubrication distribution network connected with said pump;

a primary pressure relief valve, connected in said distribution network downstream from said oil pump, for limiting the oil pressure within said distribution network to a maximum permissible value; and a dual-mode, pressure control valve, operatively connected with said distribution network downstream from said primary pressure relief valve, for controlling the pressure within said distribution network by returning oil from the distribution network to the oil reservoir, with said pressure control valve having a first operating mode, in which a pressure relief valve limits the pressure within the distribution network to a first pressure which is less than said maximum permissible value, and a second operating mode, in which said pressure relief valve limits the pressure within the distribution network to a second pressure value which is greater than said first pressure and greater than said maximum permissible value, with said dual-mode valve being operated by an engine controller as a function of at least the operating speed of the engine.

10. An engine according to claim 9, wherein said dual-mode pressure control valve comprises:

a full flow passage for normally conducting lubricating oil through said dual-mode valve:

an operating plunger for bypassing oil flowing through said full flow passage to said oil reservoir, with said plunger having an active side exposed to the pressure of said full flow passage and a control side exposed to the pressure of a resilient element, as well as to a control pressure, and with said resilient element and said control pressure both urging the operating plunger into a closed position;

a bleed orifice for balancing the pressure of lubricating oil acting on the active side and the control side of said operating plunger; and a pilot valve, operated by the engine controller, for controlling hydraulic pressure applied to the control side of said operating plunger, whereby opening the pilot valve reduces the hydraulic pressure applied to the control side of the operating plunger, permitting the operating plunger to open against the force of said resilient element, so as so allow bypass flow, reducing the pressure of lubricating oil within the distribution network.

* * * * *